US008007243B2

(12) United States Patent
Arinaga et al.

(10) Patent No.: US 8,007,243 B2
(45) Date of Patent: Aug. 30, 2011

(54) BLOWER INCLUDING BLADES ATTACHED TO A BOSS

(75) Inventors: Masahiro Arinaga, Tokyo (JP); Kunihiko Kaga, Tokyo (JP); Shoji Yamada, Tokyo (JP); Yasuaki Kato, Tokyo (JP); Hiroshi Yoshikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 968 days.

(21) Appl. No.: 11/572,302

(22) PCT Filed: Jun. 30, 2005

(86) PCT No.: PCT/JP2005/012099

§ 371 (c)(1),
(2), (4) Date: Jan. 18, 2007

(87) PCT Pub. No.: WO2006/011333

PCT Pub. Date: Feb. 2, 2006

(65) Prior Publication Data

US 2008/0019826 A1 Jan. 24, 2008

(30) Foreign Application Priority Data

Jul. 26, 2004 (JP) ..... 2004-216846

(51) Int. Cl.
*F04D 29/38* (2006.01)

(52) U.S. Cl. ..... 416/228; 415/119; 416/235; 416/236 R; 416/DIG. 2

(58) Field of Classification Search ..... 415/119; 416/228, 238, 235, 236 R, 236 A, 237, 242, 416/243, DIG. 2, DIG. 5, 223 R
See application file for complete search history.

(56) References Cited

U.S. PATENT DOCUMENTS

| | | | | |
|---|---|---|---|---|
| 6,116,856 | A * | 9/2000 | Karadgy et al. | 416/203 |
| 6,558,123 | B1 * | 5/2003 | Spaggiari | 416/238 |

FOREIGN PATENT DOCUMENTS

| | | | |
|---|---|---|---|
| CN | 1389651 | A | 1/2003 |
| CN | 1417481 | A | 5/2003 |
| EP | 1382856 | A1 * | 1/2004 |
| JP | 52-81538 | A * | 6/1977 |
| JP | 58-144698 | A * | 8/1983 |
| JP | 2002 70504 | | 3/2002 |
| JP | 2003-13892 | A * | 1/2003 |
| JP | 2003 148395 | | 5/2003 |
| WO | WO-90/13746 | A1 * | 11/1990 |

OTHER PUBLICATIONS

European Patent 1,382,856 dated Jan. 21, 2004 (abstract only).
Japanese Patent 58-144,698 dated Aug. 29, 1983 (abstract only).

* cited by examiner

*Primary Examiner* — Christopher Verdier
(74) *Attorney, Agent, or Firm* — Oblon, Spivak, McClelland, Maier & Neustadt, L.L.P.

(57) ABSTRACT

A blower that can reduce noise and enhance efficiency by improving a blade structure of the blower used for, for example, an outdoor equipment of an air conditioner. An impeller includes plural blades attached to a peripheral surface of a boss at intervals in a peripheral direction, and a trailing edge of the blade has a protrusion-shaped part in which its central part in a radial direction is curved to expand to a suction side. With such a structure, a discharge velocity of air can be made uniform along the radial direction of the blade, and it becomes possible to reduce noise and to enhance efficiency.

17 Claims, 5 Drawing Sheets

BLOWER INCLUDING BLADES ATTACHED TO A BOSS

BACKGROUND OF THE INVENTION

1. Field of the Invention

The present invention relates to a blower used for, for example, an outdoor equipment of an air conditioner, and particularly to its blade structure.

2. Description of Related Art

As a conventional blower realizing high efficiency by improvement of a blade structure, for example, as disclosed in patent document 1, there is a blower which includes an impeller made by radially attaching plural vanes (blades) to the outer periphery of a hub (boss) and in which a specific region extending in a blade span direction is curved to a negative pressure surface side along a trailing edge of the vane over a specified width.

[Patent document 1] JP-A-2003-13892 (paragraphs 20 to 30, FIGS. 1 to 4)

However, in the case where it is curved to the negative pressure surface side along the trailing edge of the blade over the specified width, since the curved portion becomes a resistance to airflow and turbulence occurs, there has been a problem that an increase in input and an increase in noise are caused.

BRIEF SUMMARY OF THE INVENTION

The invention has been made to solve the conventional problem as described above, and has an object to provide a blower which can reduce noise and enhance efficiency.

A blower of the invention includes an impeller in which plural blades attached to a peripheral surface of a boss at intervals in a peripheral direction are disposed, and a trailing edge of the blade has a protrusion-shaped part in which its central part in a radial direction is curved to expand to a suction side.

According to the invention, since the trailing edge of the blade has the protrusion-shaped part in which the central part in the radial direction is curved to expand to the suction side, the discharge velocity of gas can be made uniform in the radial direction of the blade, and it becomes possible to reduce noise and to enhance efficiency.

In addition, features of the invention are directed to a blower including an impeller having plural blades attached to a peripheral surface of a boss at intervals in a peripheral direction. For each blade an inclination of a tangent of a camber line of the blade at an equal distance from a rotating shaft increases at a boss side and a tip side from a leading edge toward a trailing edge, increases at a central part in a radial direction from the leading edge toward a vicinity of the trailing edge, and decreases from the vicinity of the trailing edge toward the trailing edge, thereby creating a raised protrusion in the central part that expands to a suction side of the blade.

DESCRIPTION OF REFERENCE NUMERALS AND SIGNS

1 impeller
2 boss
3 blade
3*a* leading edge
3*b* trailing edge
3*c* boss side end
3*d* peripheral side end (tip)
30 protrusion-shaped part
30*a* apex of protrusion-shaped part
4 motor
5 bell mouth

DETAILED DESCRIPTION OF THE INVENTION

Embodiment 1

Figure 1:
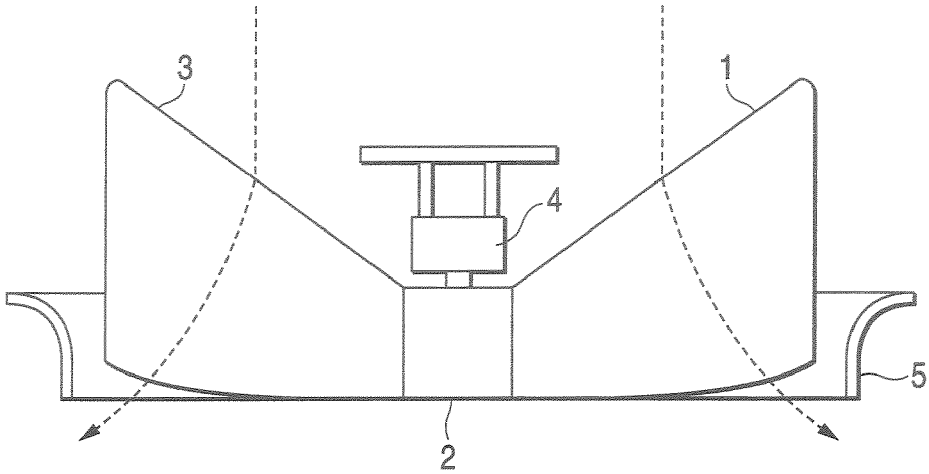
FIG. 1 is a main part sectional view of a blower according to embodiment 1.
Figure 2:
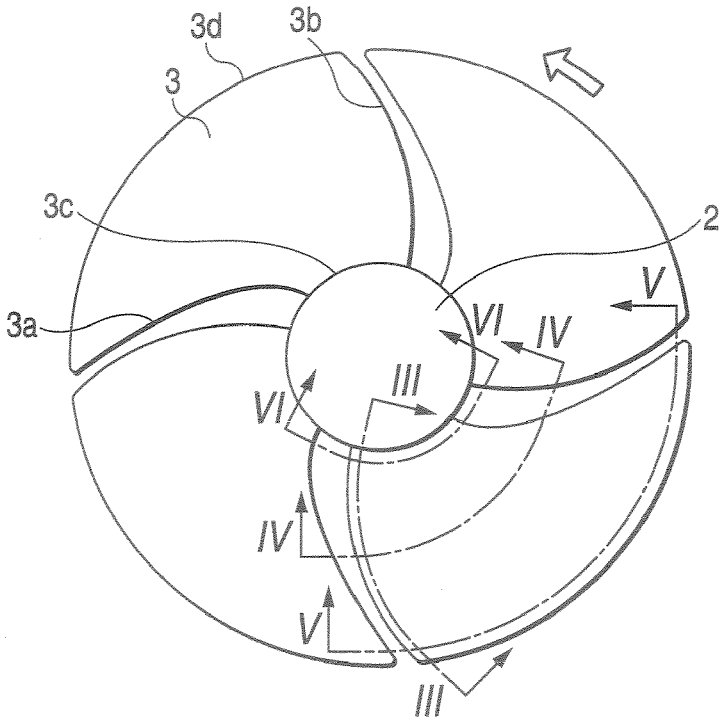
FIG. 2 is a front view of an impeller shown in FIG. 1.
Figure 3:
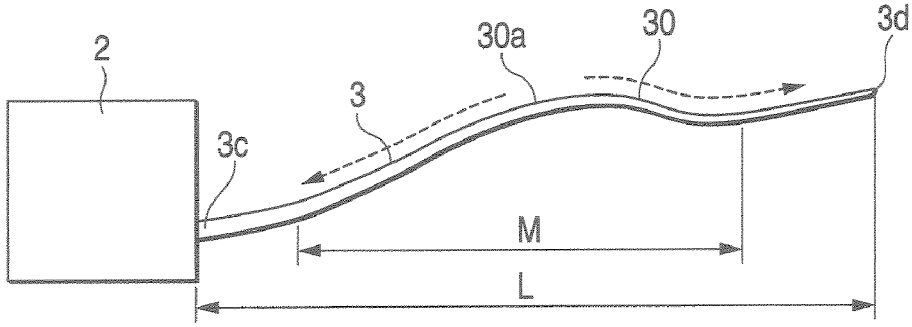
FIG. 3 is a sectional view along line III-III of FIG. 2.
Figure 4:
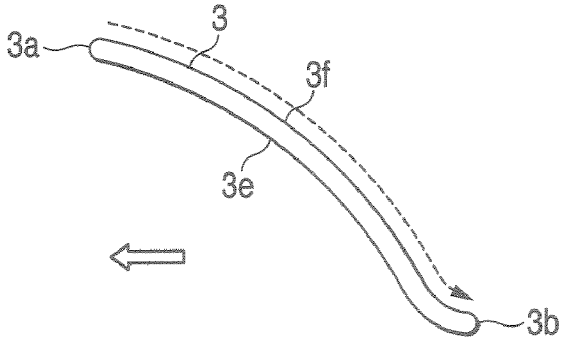
FIG. 4 is a sectional view along line IV-IV of FIG. 2.
Figure 5:
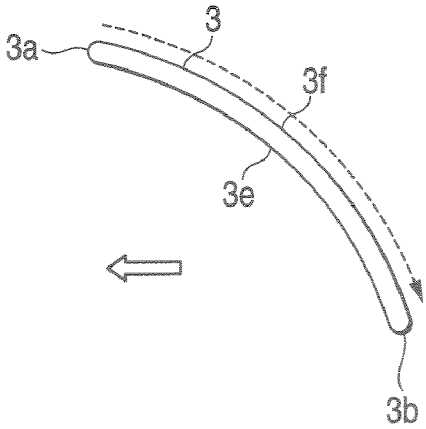
FIG. 5 is a sectional view along line V-V of FIG. 2.
Figure 6:
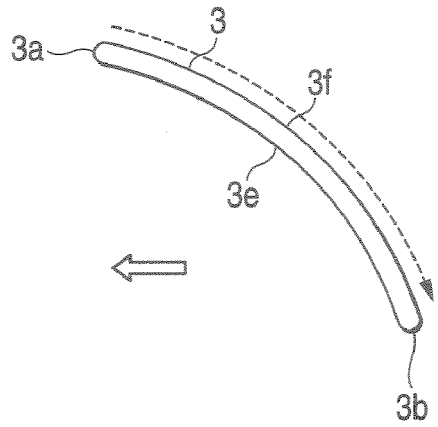
FIG. 6 is a sectional view along line VI-VI of FIG. 2.
Figure 7:
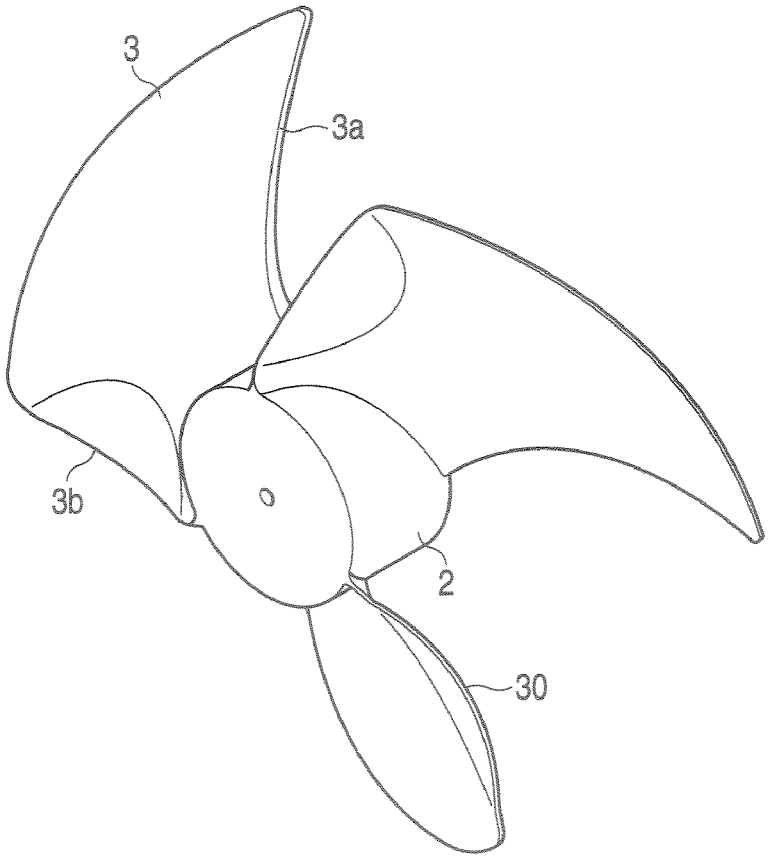
FIG. 7 is a perspective view of the impeller according to embodiment 1.
Figure 8:
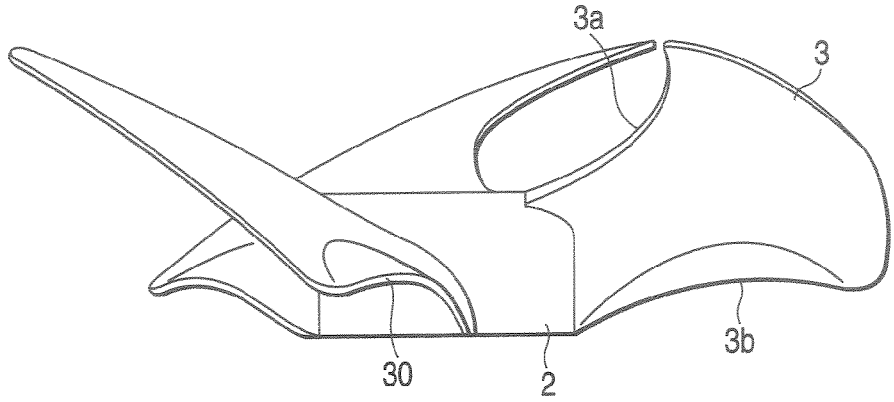
FIG. 8 is a side view of the impeller according to embodiment 1.
Figure 9:
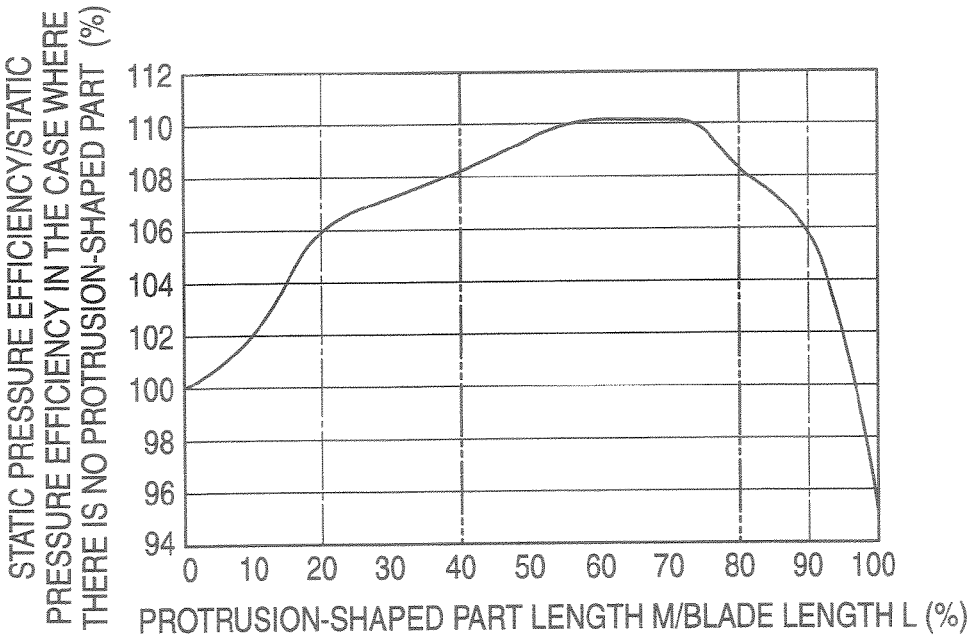
FIG. 9 is a characteristic view showing a relation between the length of a protrusion-shaped part of the blower according to embodiment 1 and static pressure efficiency.

FIGS. 1 to 9 are views for explaining a blower according to embodiment 1 of the invention, and more specifically, FIG. 1 is a main part sectional view of a blower, FIG. 2 is a front view of an impeller shown in FIG. 1, FIG. 3 is a sectional view along line of FIG. 2, FIG. 4 is a sectional view along line IV-IV of FIG. 2, FIG. 5 is a sectional view along line V-V of FIG. 2, FIG. 6 is a sectional view along line VI-VI of FIG. 2, FIG. 7 is a perspective view of the impeller, FIG. 8 is a side view of the impeller, and FIG. 9 is a characteristic view showing a relation between the length of a protrusion-shaped part and static pressure efficiency. Incidentally, in the respective sectional views, hatching indicating a section is omitted.

This blower is an axial-flow blower, and is constructed such that an impeller 1 in which plural blades 3, 3 . . . are radially attached to the peripheral surface of a boss 2 at a specified attachment angle can be rotation driven by a motor 4, and a bell mouth 5 is disposed at a peripheral side of the impeller 1 so as to surround the impeller 1. Incidentally, although FIG. 2 shows the impeller 1 having the four blades 3, and FIGS. 7 and 8 show the impeller 1 having the three blades 3, the number of the blades 3 is not limited to three or four.

As shown in FIGS. 2 to 8, the blade 3 of the impeller 1 is a "forward swept wing" in which its leading edge 3*a* extends forward in the rotation direction, and has a specified "warp" in a blade chord direction, its concave side surface is a pressure surface 3*e*, and its convex side surface is a negative pressure surface 3*f*. Incidentally, in FIG. 2 and FIGS. 4 to 6, an outlined arrow indicates a rotation direction of the impeller, and in FIG. 1 and FIGS. 3 to 6, an arrow of a broken line indicates a direction in which a wind (fluid) flows.

The most characteristic point of the blade 3 is that a trailing edge 3*b* of the blade 3 has a protrusion-shaped part in which its central part in a radial direction is curved to expand to a suction side. In more details, a protrusion-shaped part 30 of the trailing edge 3*b* is such that the central part in the radial direction is curved to expand to the suction side and to smoothly incline to both end sides in the radial direction, that is, to a boss side end 3*c* and a tip (peripheral side end) 3*d* side.

The distribution of axial direction flow velocity at the discharge side of the blade 3 of a general axial-flow blower is such that as described later in detail, it increases from the boss 2 side to the central part in the radial direction, and decreases from the central part to the tip 3*d* side.

That is, at the boss 2 side of the blade 3, the flow is directed to the tip 3*d* side by the centrifugal force, so that the volumetric flow rate at the boss 2 side is decreased, and the axial direction flow velocity is decreased. There is a problem that since the flow velocity is decreased as stated above, the efficiency is lowered. Further, there is a problem that a wing-surface separated flow occurs due to an insufficient volumetric flow rate, and there occur a decrease in efficiency due to the turbulence and an increase in noise.

Besides, since the volumetric flow rate concentrates at the central part of the blade 3 in the radial direction, the flow velocity increases. Since the noise of the impeller 1 increases mainly in proportion to the sixth power of the flow velocity, there is a problem that as the flow velocity increases, the noise increases. Further, a component in the rotation direction of the blade 3 is large in the vicinity of the central part of the blade 3 in the radial direction, and input loss due to a discharge dynamic pressure becomes a problem.

Besides, at the tip 3*d* side of the blade 3, the volumetric flow rate is decreased by a leak flow produced from a tip clearance as a gap between the blade 3 and the casing (bell mouth 5) by the difference in pressure produced at the suction side and the discharge side of the blade 3 or a wing tip vortex developing from the leading edge 3*a* of the blade 3. As a result, the wing-surface separated flow occurs due to the insufficient volumetric flow rate, and an increase in noise due to the turbulence occurs. Further, since the flow velocity is decreased, the efficiency is lowered. When the flow velocity is decreased at the peripheral part of the blade 3 where the peripheral speed of the blade 3 is high and the work efficiency is high, the efficiency is significantly lowered.

As described above, the distribution of the flow velocity occurs at the discharge side in the radial direction of the blade 3, and the flow becomes slow at the boss 2 side and the tip 3*d* side, and the flow becomes fast at the central part, and consequently, there occur a decrease in efficiency due to the distribution of the flow velocity and an increase in noise.

On the other hand, in this embodiment, since the trailing edge 3*b* of the blade 3 has the protrusion-shaped part in which the central part in the radial side is curved to expand to the suction side, the flow concentrating at the central part of the blade 3 in the radial direction flows along the inclination of the protrusion-shaped part 30 as indicated by arrows in FIG. 3, and is divided by the protrusion-shaped part 30 to the boss 2 side and the peripheral side.

At the boss 2 side of the blade trailing edge 3*b*, the flow concentrating at the central part of the blade 3 in the radial direction flows along the inclination of the protrusion-shaped part 30, and flows into the boss 2 side, so that the separated flow region due to the insufficient volumetric flow rate is decreased. Since the volumetric flow rate is increased, the efficiency is increased, the noise due to the turbulence produced by the separation is decreased, and it becomes possible to enhance the efficiency of the impeller 1 and to reduce the noise.

Since the central part of the blade trailing edge 3*b* in the radial direction is curved to expand to the suction side, the blade 3 gives a small velocity component in the rotation direction to the flow and flows in the axial direction, and accordingly, the loss due to the discharge dynamic pressure is lowered, and it becomes possible to increase the efficiency. Further, since the flow concentrating at the central part of the blade 3 flows along the inclination of the protrusion-shaped part 30 and is supplied to the boss 2 side and the peripheral side, the volumetric flow rate at the central part of the blade 3 is decreased, and the maximum flow velocity of the blade 3 is decreased, so that the noise is reduced.

At the tip 3*d* side of the blade trailing edge 3*b*, since the flow concentrating at the central part of the blade 3 in the radial direction flows along the inclination of the protrusion-shaped part 30 and flows into the tip 3*d* side of the blade 3, the separation region due to the insufficient volumetric flow rate is decreased. Since the volumetric flow rate is increased, the efficiency at the tip 3*d* side of the blade 3 is increased, the noise due to the turbulence produced by the separation is reduced, and it becomes possible to enhance the efficiency of the impeller 1 and to reduce the noise. Further, at the tip 3*d* side of the blade 3, since the peripheral speed of the blade 3 is high, the velocity distribution which has been irregular since the blade 3 gives the velocity component in the rotation direction to the fluid, is made uniform, it becomes possible to cause the work to be done well-balancedly in the radial direction of the blade 3, and the efficiency of the blade 3 is increased. Further, since the work load is large at the tip 3*d* side, the amount of pressure increase is large, and it becomes possible to increase the efficiency by the increase in static pressure of the blade 3.

As described above, in this embodiment, since the trailing edge 3*b* of the blade 3 has the protrusion-shaped part in which the central part in the radial direction expands to the suction side, the flow concentrating at the central part of the blade 3 in the radial direction flows along the inclination of the protrusion-shaped part 30 and flows into the boss 2 side and the tip 3*d* side, the volumetric flow rate of the discharge flow is made uniform in the respective regions of the boss 2 side of the blade 3 in the radial direction, the central part, and the tip 3*d* side. Accordingly, since it becomes possible for the blade 3 to work uniformly in the radial direction, a region which causes the efficiency loss of the blade 3 is decreased, and the total efficiency of the blade 3 can be increased.

In addition, since the discharge flow velocity of the blade 3 becomes uniform, the maximum flow velocity is decreased, and the noise of the impeller 1 dependent on the sixth power of the flow velocity is reduced.

Incidentally, when the region of the protrusion-shaped part 30 is narrow, that is, the length (indicated by M in FIG. 3) of the protrusion-shaped part 30 in the radial direction is short with respect to the length (indicated by L in FIG. 3) of the blade 3 in the radial direction, the region where the flow is divided is decreased, the amount of decrease of the separation region at the boss 2 side of the blade 3 and the tip 3*d* side becomes small, and it becomes impossible to reduce the loss due to the separation. As stated above, when the length of the protrusion-shaped part 30 in the radial direction is short, the decrease of the separation region is small, and the amount of efficiency improvement is lowered.

On the contrary, when the region of the protrusion-shaped part 30 is wide, that is, the length M of the protrusion-shaped part in the radial direction is long with respect to the length L of the blade 3 in the radial direction, the region where the flow is divided is increased, and the region into which the divided flow flows is decreased, and accordingly, the amount of inflow to the boss 2 side of the blade 3 and the tip 3*d* side is increased, so that the maximum speed of the discharge flow velocity is increased, and the noise is increased.

FIG. 9 is a characteristic view showing a relation between the ratio (M/L) of the length of the protrusion-shaped part in the radial direction to the length of the blade in the radial direction and the static pressure efficiency. Incidentally, in FIG. 9, the length of the protrusion-shaped part in the radial direction is indicated by the ratio M/L to the length of the blade in the radial direction, and the static pressure efficiency is indicated by the ratio to the static pressure efficiency in the case where the protrusion-shaped part is not provided. Besides, FIG. 9 shows the characteristic in the case where there is nothing to block the flow of wind except the impeller 1 and the bell mouth 5, which is simulation results.

Although the separation regions at the boss 2 side of the blade 3 and the tip 3*d* side slightly vary according to the existence of the bell mouth 5 and the casing, the difference in shape, the difference in wind path shape, and the like, from FIG. 9, it is understood that when the length of the protrusion-shaped part 30 in the radial direction is made to be in the range ($0.2L \leqq M \leqq 0.9L$) from 20% to 90% of the length of the blade 3 in the radial direction, more preferably, in the range ($0.4L \leqq M \leqq 0.8L$) from 40% to 80%, the discharge flow is efficiently controlled, the discharge velocity of gas can be made uniform in the radial direction of the blade, and it becomes possible to more certainly reduce noise and to enhance efficiency.

Embodiment 2

Figure 10:
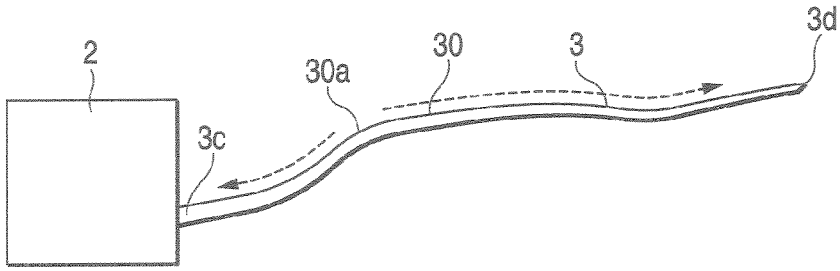
FIG. 10 is a main part sectional view of a blower according to embodiment 2.
Figure 11:
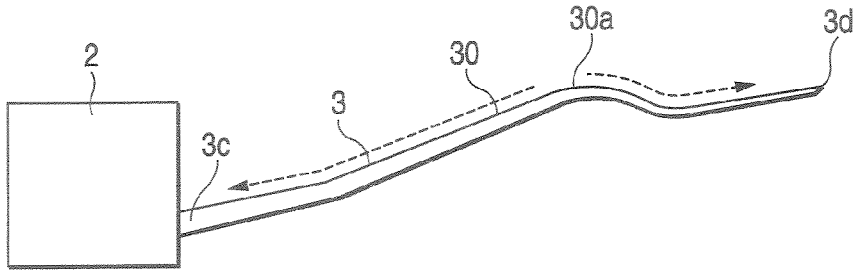
FIG. 11 is a main part sectional view showing another structural example of the blower according to embodiment 2.

FIGS. 10 and 11 are main part sectional views of a blower according to embodiment 2 of the invention, and correspond to FIG. 3 of embodiment 1.

In the former embodiment, although the apex 30*a* of the protrusion-shaped part 30 is located in the vicinity of the midpoint of the trailing edge 3*b* of the blade 3 in the radial direction, in this embodiment, it is located at a position deviated from the midpoint in the radial direction to the boss 2 side or the tip 3*d* side. Since other structures are similar to embodiment 1, a different point from embodiment 1 will be mainly described below.

FIG. 10 shows a case where the apex 30*a* of the protrusion-shaped part 30 is moved to the boss 2 side. As stated above, when the apex 30*a* of the protrusion-shaped part 30 of the trailing edge 3*b* is moved to the boss 2 side, when the flow concentrating at the central part of the blade 3 in the radial direction flows along the inclination of the protrusion-shaped part 30, the volumetric flow rate of the divided flow is small at the boss 2 side and becomes large at the tip 3*d* side.

In the case where large separation due to the insufficient volumetric flow rate occurs at the tip side 3*d* of the blade 3, since the volumetric flow rate is increased, the efficiency at the tip 3*d* side of the blade 3 is increased, noise due to the turbulence produced by the separation is reduced, and it becomes possible to enhance the efficiency of the impeller 1 and to reduce the noise. Further, at the tip 3*d* side of the blade 3, since the peripheral speed of the blade 3 is high, the amount of work in which the blade 3 gives the rotary component to the fluid is large, and accordingly, the amount of pressure increase is large, and it becomes possible to increase the efficiency by increase in static pressure of the impeller 1.

FIG. 11 shows a case where the apex 30*a* of the protrusion-shaped part 30 is moved to the tip 3*d* side. As stated above, when the apex 30*a* of the protrusion-shaped part 30 of the trailing edge 3*b* is moved to the tip 3*d* side, when the flow concentrating at the central part of the blade 3 in the radial direction flows along the inclination of the protrusion-shaped part 30, the volumetric flow rate of the divided flow becomes large at the boss 2 side and becomes small at the tip 3*d* side.

In the case where large separation due to the insufficient volumetric flow rate occurs at the boss 2 side of the blade 3, since the volumetric flow rate is increased, the efficiency at the tip 3*d* side of the blade 3 is increased, noise due to the turbulence produced by the separation is reduced, and it becomes possible to enhance the efficiency of the impeller 1 and to reduce the noise.

As stated above, by the shape of the protrusion-shaped part 30, it becomes possible to control the ratio of the volumetric flow rate of the flow directed to the boss 2 side of the blade 3 to the volumetric flow rate of the flow directed to the tip 3*d* side, and it becomes possible to control the work distribution of the blade 3 in the radial direction.

Accordingly, in the case where the suction distribution of fluid in the radial direction of the blade 3 is irregular by a mounting form of the impeller 1, the position of the apex 30*a* of the protrusion-shaped part 30 is moved to the boss 2 side or the tip 3*d* side in accordance with a flow. That is, when the volumetric flow rate at the boss 2 side is increased according to the characteristic of the impeller 1, the position of the apex 30*a* of the protrusion-shaped part 30 is moved to the tip 3*d* side, and when the volumetric flow rate at the tip 3*d* side is increased, the position of the apex 30*a* of the protrusion-shaped part 30 is moved to the boss 2 side. Consequently, it is possible to create uniform discharge volumetric flow rate distribution of the impeller 1, and it becomes possible to enhance the efficiency of the impeller 1 and to reduce the noise.

As stated above, when the position of the apex 30*a* of the protrusion-shaped part 30 is moved to the boss 2 side, the flow is attracted to the tip 3*d* side, and when the position of the apex 30*a* of the protrusion-shaped part 30 is moved to the tip 3*d* side, the flow is attracted to the boss 2 side, and accordingly, it becomes possible to control the discharge flow of the impeller 1. Accordingly, also in a wind path in a product mounting state where there is trouble at the discharge side, when the position of the apex 30*a* of the protrusion-shaped part 30 is moved to the boss 2 side or the tip 3*d* side in accordance with the flow, it becomes possible to suppress the interference between the discharge flow and the wind path to the minimum, and it becomes possible to enhance the efficiency of the blower including the wind path.

Figure 12:
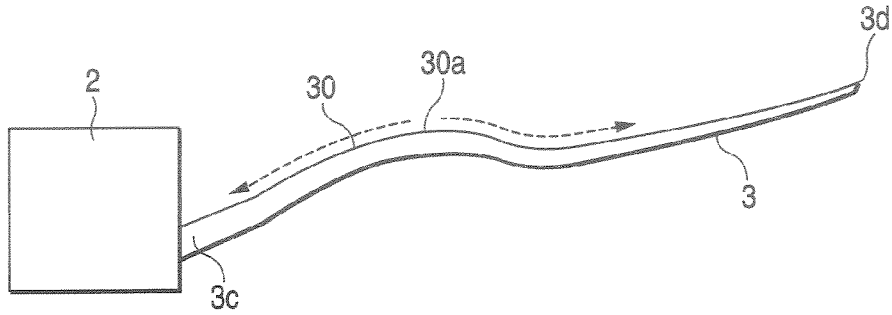
FIG. 12 is a main part sectional view showing another structural example of the blower according to embodiment 2.
Figure 13:
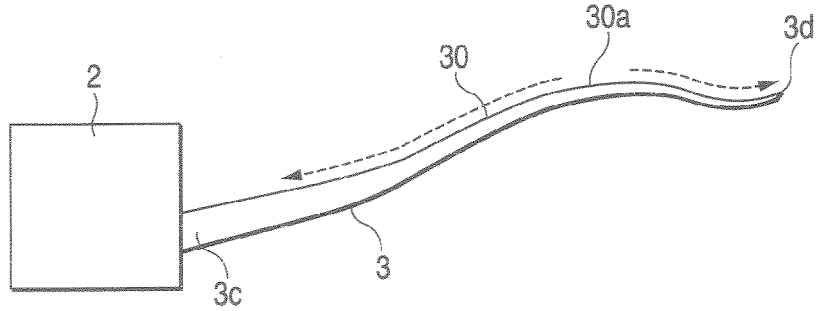
FIG. 13 is a main part sectional view showing another structural example of the blower according to embodiment 2.

Incidentally, FIGS. 10 and 11 show the case in which the position of the apex 30*a* of the protrusion-shaped part 30 is changed while the position where the protrusion-shaped part 30 is provided is not changed but is the same as embodiment 1, that is, the case where the shape of the protrusion-shaped part 30 is not axisymmetric with respect to the apex 30*a* between the boss 2 side and the peripheral side. On the other hand, as shown in FIGS. 12 and 13, the position where the protrusion-shaped part 30 is provided may he changed, while the shape of the protrusion-shaped part 30 is not changed and is made axisymmetric with respect to the apex 30*a* between the boss 2 side and the peripheral side. Also in this case, since the apex 30*a* of the protrusion-shaped part 30 can be located at a position deviated from the midpoint in the radial direction to the boss 2 side or the tip 3*d* side, a similar effect can be obtained.

Incidentally, also in this embodiment, similarly to the case of embodiment 1, when the length of the protrusion-shaped part 30 in the radial direction is made to be in the range of 20% to 90% of the length of the blade 3 in the radial direction, more desirably, the range of 40% to 80%, the discharge flow is efficiently controlled, the discharge velocity of air can be made uniform in the radial direction, and it becomes possible to more certainly reduce the noise and to enhance the efficiency.

The invention claimed is:

1. A blower comprising:

an impeller including plural blades attached to a peripheral surface of a boss at intervals in a peripheral direction, each of the plural blades having a trailing border, wherein each blade includes a protrusion-shaped part curved to expand to a suction side of the blade at a central part of the blade in a radial direction from a portion of the blade in proximity to the trailing border, to the trailing border, the protrusion-shaped part includes an apex located on the suction side of the trailing border, and the protrusion-shaped part inclines in the radial direction from the apex to a boss side of the trailing border and from the apex to a tip side of the trailing border.

2. A blower according to claim 1, wherein the apex of the protrusion-shaped part is located at a midpoint of the blade in the radial direction.

3. A blower according to claim 1, wherein the apex of the protrusion-shaped part is located at a position deviated to a boss side of the blade.

4. A blower according to claim 1, wherein the apex of the protrusion-shaped part is located at a position deviated to a tip side of the blade.

5. A blower according to claim 1, wherein a length of the protrusion-shaped part in the radial direction is in a range of 20% to 90% of a length of the blade in the radial direction.

6. A blower according to claim 1, wherein a length of the protrusion-shaped part in the radial direction is in a range of 40% to 80% of a length of the blade in the radial direction.

7. A blower according to claim 1, wherein the protrusion-shaped part gradually increases in size in a direction from a leading edge to the trailing border.

8. A blower according to claim 1, wherein the protrusion-shaped part is curved to expand to the suction side of the blade in a direction that is parallel to an axial direction defined by a rotational axis of the blade and the trailing border of the blade is defined by a continuous arc in the radial direction.

9. A blower according to claim 1, wherein the blade is made from a material, and the trailing border of the blade is defined by an outermost edge of the material.

10. A blower comprising:

an impeller including plural blades attached to a peripheral surface of a boss at intervals in a peripheral direction, wherein for each blade an inclination of a tangent of a camber line of the blade at an equal distance from a rotating shaft increases at a boss side and a tip side from a leading edge toward a trailing edge, increases at a central part in a radial direction from the leading edge toward a vicinity of the trailing edge, and decreases from the vicinity of the trailing edge toward the trailing edge, thereby creating a raised protrusion in the central part that expands to a suction side of the blade.

11. A blower according to claim 10, wherein an apex of the raised protrusion is located at a midpoint of the blade in the radial direction.

12. A blower according to claim 10, wherein an apex of the raised protrusion is located at a position deviated to a boss side of the blade.

13. A blower according to claim 10, wherein an apex of the raised protrusion is located at a position deviated to a tip side of the blade.

14. A blower according to claim 10, wherein a length of the raised protrusion in the radial direction is in a range of 20% to 90% of a length of the blade in the radial direction.

15. A blower according to claim 10, wherein a length of the raised protrusion in the radial direction is in a range of 40% to 80% of a length of the blade in the radial direction.

16. A blower according to claim 10, wherein the raised protrusion gradually increases in size in a direction from the leading edge to the trailing edge.

17. A blower according to claim 10, wherein the raised protrusion expands to the suction side of the blade in a direction that is parallel to an axial direction defined by a rotational axis of the blade and the trailing edge of the blade is defined by a continuous arc in the radial direction.

* * * * *